United States Patent [19]

Nybo

[11] 4,265,567

[45] May 5, 1981

[54] RISER DEVICE

[75] Inventor: Reidar Nybø, Hvalstad, Norway

[73] Assignee: A/S Akers Mek. Verksted, Oslo, Norway

[21] Appl. No.: 961,413

[22] Filed: Nov. 16, 1978

[30] Foreign Application Priority Data

Nov. 30, 1977 [NO] Norway ..... 774098

[51] Int. Cl.[3] ..... E02B 17/00

[52] U.S. Cl. ..... 405/195; 166/367; 405/169

[58] Field of Search ..... 405/195, 203–210; 141/388, 387, 382; 166/355, 359, 367; 114/230

[56] References Cited

U.S. PATENT DOCUMENTS

| | | | |
|---|---|---|---|
| 2,648,201 | 8/1953 | Marancik et al. | 141/388 UX |
| 3,249,121 | 5/1966 | Bily | 141/388 X |
| 3,452,787 | 7/1969 | Bily | 141/388 |
| 3,834,432 | 9/1974 | Lilly et al. | 141/388 |
| 3,999,498 | 12/1976 | Flory | 114/230 |
| 4,067,202 | 1/1978 | Reed | 405/195 |
| 4,100,752 | 7/1978 | Tucker | 405/210 X |

FOREIGN PATENT DOCUMENTS 1404775 9/1975 United Kingdom .

*Primary Examiner*—Dennis L. Taylor

*Attorney, Agent, or Firm*—Watson, Cole, Grindle & Watson

[57] ABSTRACT

The present invention relates to a riser device which extends from an underwater installation up to a structure situated near the water's surface, and which comprises at least three rigid, elongate members each having associated therewith at least one fluid flow line. The elongate members are interconnected by means of universal joints and have sufficient lengths that the total length of the riser device will exceed the distance between the underwater installation and the structure.

5 Claims, 5 Drawing Figures

22
11
9
7
4
2
14
5
15
1
3
6
10
12
8
13

RISER DEVICE

BACKGROUND OF THE INVENTION

During transfer of liquid or gas from a subsea pipeline or other installation at great ocean depths to a floating structure by riser devices, high loads must be endured thereby due to currents, waves, or motions of the structure. Furthermore, rather strong internal wear caused by the flowing fluids, as well as external corrosion, will tend to shorten the useful lives of the riser devices.

In Norwegian Pat. No. 136 243 an articulated riser device is suggested which comprises fluid conducting lines which are rigidly connected to a part which is connected to similar parts by means of universal joints. Such a riser device is not a very stable structure and will experience relatively large horizontal and vertical motions due to comparably small forces, and the device will thus be subjected to oscillations which entail danger for subsequent fatigue and failure of the parts of the structure.

Internal wear from the conveyed fluid and external corrosion have lately turned out to be more extensive than previously assumed, and maintenance requirements are therefore constantly being made more stringent. Thus, the previously known riser devices will have to be replaced relatively often. This entails considerable expenditures, while time consuming replacement work leads to large production losses.

The object of the present invention is to provide a riser device of the type mentioned by way of introduction, which device eliminates, or to a large extend reduces the noted drawbacks and deficiencies. A detailed understanding of the invention will be obtained by reference to the following discussing taken in conjunction with the accompanying drawings.

DETAILED DESCRIPTION OF THE PREFERRED EMBODIMENTS

Figure 1:
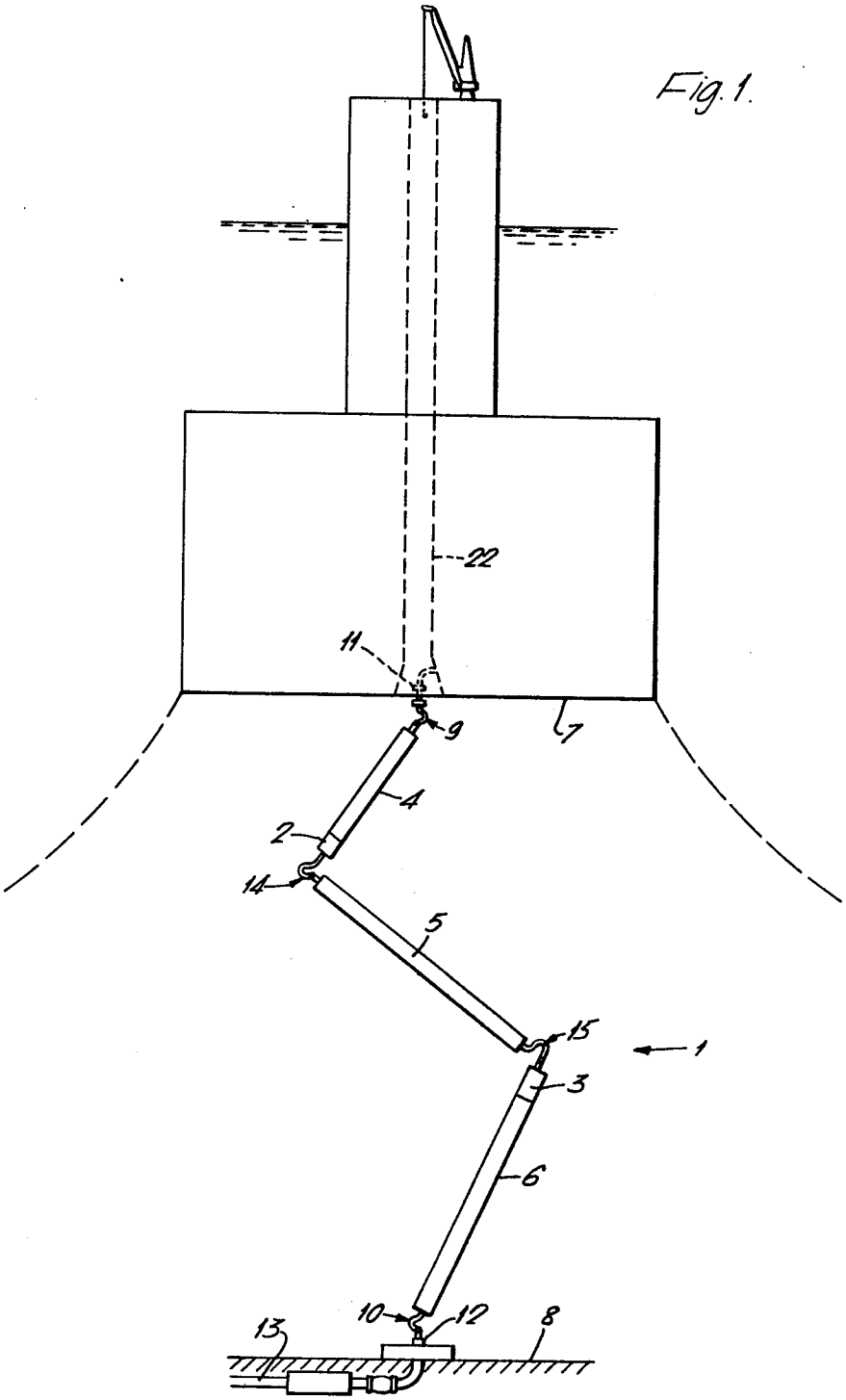
FIG. 1 schematically depicts a riser device according to the invention in elevation.

The riser device, in the following called riser 1, comprises separate members 4, 5 and 6 is arranged so that the different constituent members 4, 5 and 6 will assume a pronounced zigzag form as shown in FIG. 1. The upper end portion of the upper member 4 is movably attached to a floating structure 7 by means of a flexible joint 9 and a preferably remotely controlled hydraulic coupling 11, while the lower end portion of the lower member 6 is similarly movably attached to a subsea pipeline 13 or the like on the ocean floor 8 by means of a flexible joint 10 and a preferably hydraulic coupling 12. The middle or third member 5 of the system connects the two members 4 and 6 together by means of flexible joints 14 and 15.

In order to reduce the oscillation amplitudes that may occur in the pipeline as a result of varying external forces, the upper portion riser 1 is made self-stabilizing by furnishing the upper member 4 with a weight means 2 in its lower portion, this weight means subjecting the system to a downwardly directed force acting primarily in the area where members 4 and 5 are interconnected. Furthermore, the lower member 6 is furnished in its upper portion with a buoyancy means, such as a chamber 3 which can contain a variable amount of a lighter-than-water substance such as air, and this buoyancy means provides the system with an upwardly directed force substantially in the area where members 5 and 6 are interconnected.

The upper member 4 of the riser acts like a suspended pendulum depending from the floating structure 7. The lower member 6 acts like a standing pendulum which is attached to the ocean floor and is held in upwardly directed position by the action of the buoyancy means. The middle member 5 acts like a strut pushing the two pendulums 4 and 6 out from their equilibrium positions. As is well known, a pendulum which is brought out from its equilibrium position will tend to act against this position with a force, and it is this principle that here has been used in order to stabilize the riser 1.

The downwardly directed action of the weight means 2 may also be distributed along the length of the member 4, for instance by forming part of the structure. Likewise, the upwardly directed action from the single buoyancy means 3 may be replaced by several buoyancy bodies placed on the member 4. In order to obtain the desired cooperation between a suspended and a standing pendulum, the riser 1 must consist of at least three members 4, 5, 6, and this is thus a preferred embodiment.

Figure 2:
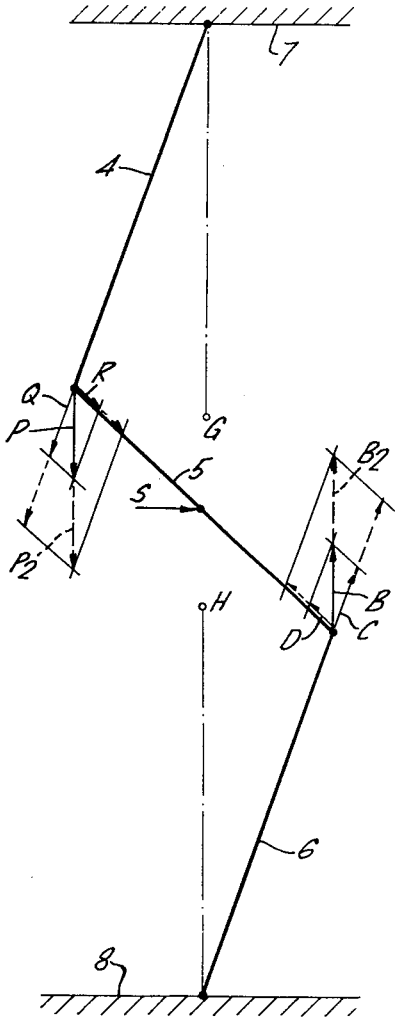
FIG. 2 and FIG. 3 illustrate some of the forces acting on a device according to FIG. 1 in two different positions.

The stabilizing principle is shown in an example in FIG. 2. Here, the riser 1 is illustrated as a suspended pendulum 4, a standing pendulum 6 and a strut 5 which pushes these out from their equilibrium positions G and H. In this example, the members 4, 5, 6 are assumed to have a weight equalling their buoyancy. The weight means 2 is represented by the downwardly directed force P and the buoyancy means 3 by the upwardly directed force B. For simplicity, the members 4 and 6 have been made equally long. The force P may be split into a component force Q which acts in the longitudinal direction of the member 4, and a component force R which acts in the longitudinal direction of the member 5. The force B may be split into the force C acting in the longitudinal direction of the member 6 and the force D acting in the longitudinal direction of the member 5. The force components Q and C will constantly act perpendicular by perpendicularly to the pendulum orbits and will have no influence on the motions. The two other components R and D tend to accelerate the pendulums toward their equilibrium positions G and H. The condition for equilibrium, when other forces are not present, is that R and D are equal and opposite. FIG. 2 shows the system in equilibrium.

If the system is given a displacement, the relationship between the components will change, but always in such a way that there will be a resultant force acting towards the equilibrium position of the system. This is shown in an example in FIG. 3, where the system is subjected to an external force S giving a displacement towards the right to a new equilibrium position. The suspended pendulum will move towards its equilibrium position G while the standing pendulum will move away from its equilibrium position H. The component forces R and D will change to $R_1$ and $D_1$ in such a way that $R_1$ will be smaller than $D_1$, and the resultant will act along the strut 5 against the external force S and will try to bring the system back to its natural equilibrium position. The longer out from its natural equilibrium position the system is brought, the larger the resultant will be. If the member 4 is brought past the point G, $R_1$ and $D_1$ will act in the same direction.

Figure 3:
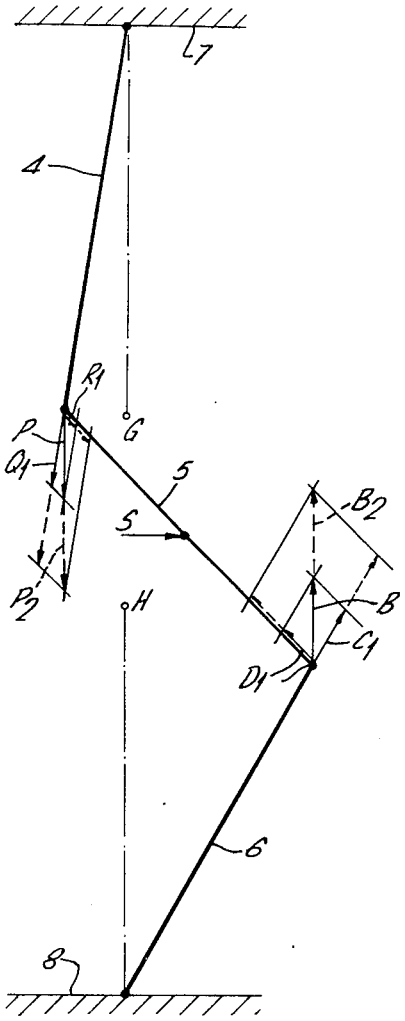

If P and B are increased to, say, $P_2$ and $B_2$ as shown in FIGS. 2 and 3, the components R and D and the resultant of these will increase in the same proportion. When applied to the riser 1, this means that the system may be made stiffer or softer by varying the magnitude of P and B, so that it will take a larger or smaller force, respectively, to bring the system a given distance out from its natural equilibrium position. The length of the members of the riser will be decisive for the water depth at which these may be installed while concurrently maintaining the desired stabilizing effect.

Figure 4:
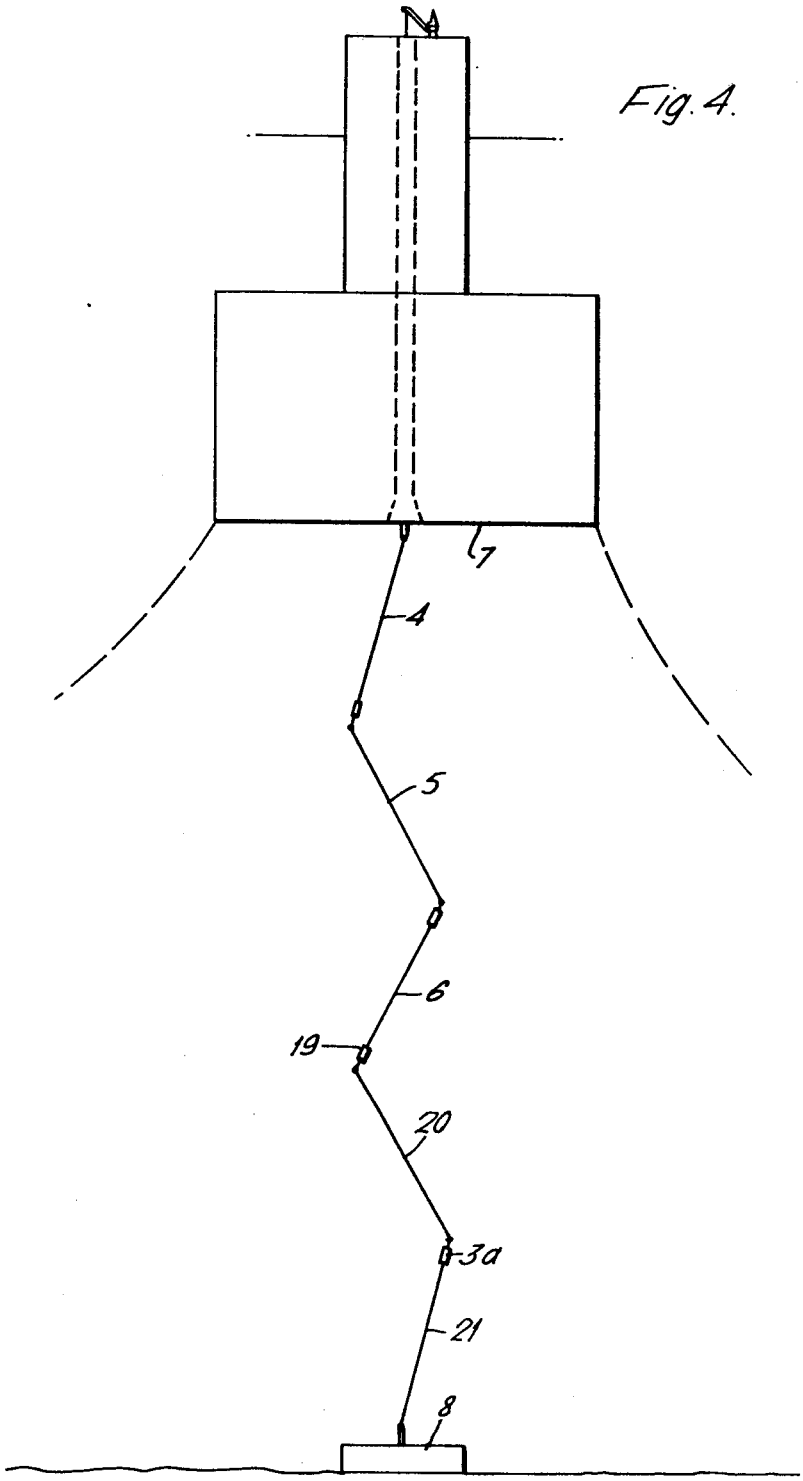
FIG. 4 schematically shows in elevation an alternative embodiment of the invention for reaching greater depths.

For greater depths the riser may be extended by introducing more members as shown in FIG. 4. Here, the same principle is utilized by alternatingly employing suspended and standing pendulums with rigid struts in between.

In the arrangement of a riser as shown in FIG. 4 with more than three members, the total length of these must be adjusted to the ocean depth at hand so that the above-mentioned zigzag form is maintained. The form of the members 4 and 5 remains unchanged, while the member 6 must be equipped with a weight means 19 at its lower end portion in order for the stabilizing effect to be maintained. The member 20 is made like member 5, while member 21 is equipped with a buoyancy means in the form of a chamber 3*a* at its upper portion.

Further members may be connected in a similar manner in order to extend the riser 1.

The riser 1 may be released from its attachment 12 on the ocean floor and be pulled into the floating structure 7 through the shaft 22 by means of a crane or the like, as shown in FIG. 1.

In order that this work may easily be done with a riser according to the invention in three parts, the two lower riser members 5 and 6 must be lowered, say, by reducing the buoyancy of the chamber 3. Thereby, the upper member 4 will assume a generally vertical position and may be pulled into the shaft 22. When the upper member has been pulled in, the middle member 5 must also be vertical in order to be pulled into the shaft. This may be assured by making the total length of the two lower riser members 5 and 6 equal or less than the distance between the bottom and the floating structure. Alternatively, the body 7 may be raised sufficiently for the riser 1 to assume a straight vertical position for retraction.

Figure 5:
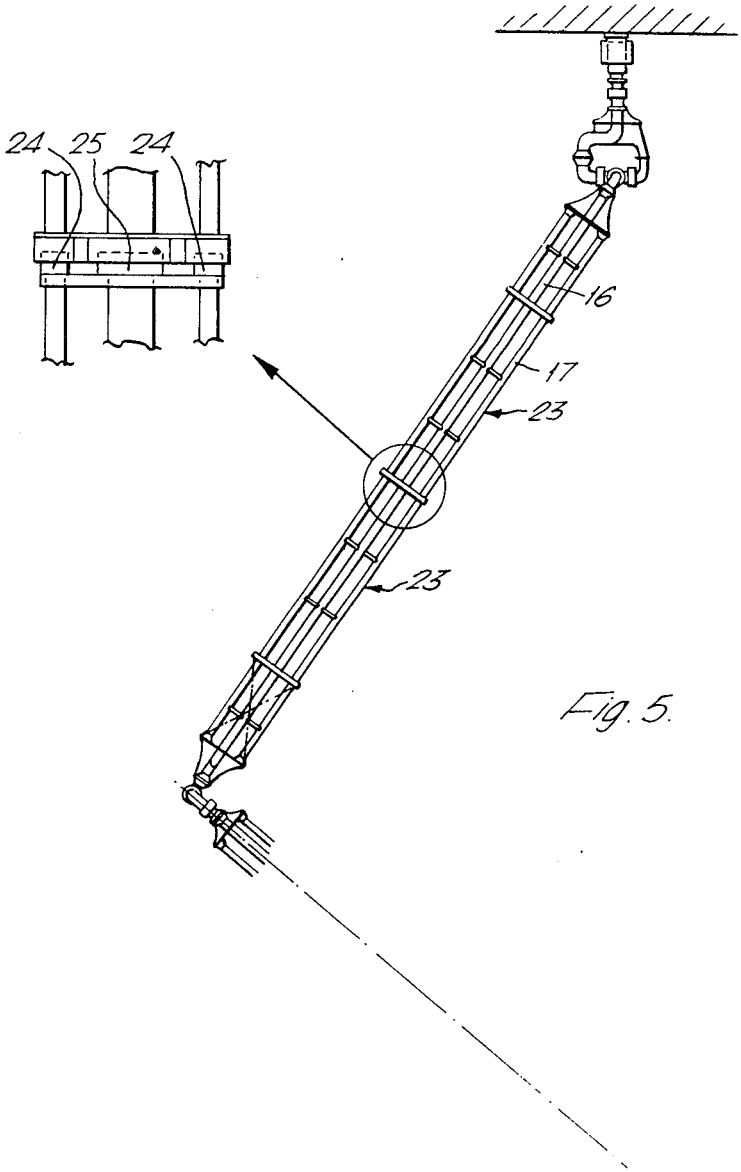
FIG. 5 shows some of the parts of the inventive riser device in greater detail.

Inside the shaft the riser may be disassembled and new parts quickly exchanged. This is possible by the subdivision of the riser into sections 23 which may be connected by means of quick connect couplings 24 and 25 as shown in FIG. 5. The fluid pipe 16 is connected together by means of couplings 25 and the structural struts 17 by means of couplings 24.

I claim:

1. A riser device extendable between an underwater installation and a structure near the water's surface, said riser device comprising at least three rigid elongated members which can be attached end-to-end to extend between an underwater installation and a structure near the water's surface, the total length of said elongated members being greater than the distance between the underwater installation and the structure, said members supporting interconnected fluid flow lines, the upper end of the uppermost elongated member being connected to the structure by means of a universal joint, the lower end of the lowermost elongated member being connected to the underwater installation by means of a universal joint, and the remaining ends of the elongated members being connected to each other by means of universal joints, and at least the uppermost elongated member having a weight along its length which allows it to operate as a suspended pendulum, at least the lowermost elongated member having a weight along its length which allows it to operate as a standing pendulum, and at least one of the remaining members has a weight which allows it to operate as a strut.

2. A riser device as claimed in claim 1 wherein at least the uppermost elongated member includes at least one weight means attached thereto and wherein at least the lowermost elongated member includes at least one buoyancy means attached thereto.

3. A riser device as claimed in claim 2 wherein said buoyancy means comprises a chamber which can contain a varying amount of light-than-water substance.

4. A riser device as claimed in claim 1 wherein said riser device comprises three elongated members.

5. A riser device as claimed in claim 4 wherein the uppermost elongated member of said three elongated members includes a weight means attached adjacent the lower end thereof, and wherein the lowermost elongated member of said three elongated members includes a buoyancy means in the form of a chamber containing air, said chamber being located adjacent the upper end thereof.

* * * * *